US012605617B2

(12) United States Patent
Shields

(10) Patent No.: US 12,605,617 B2
(45) Date of Patent: Apr. 21, 2026

(54) WORD BOARD GAME APPARATUS AND METHOD

(71) Applicant: Ryan Shields, Springfield, MO (US)

(72) Inventor: Ryan Shields, Springfield, MO (US)

( * ) Notice: Subject to any disclaimer, the term of this patent is extended or adjusted under 35 U.S.C. 154(b) by 545 days.

(21) Appl. No.: 18/187,142

(22) Filed: Mar. 21, 2023

(65) Prior Publication Data

US 2023/0310977 A1 Oct. 5, 2023

Related U.S. Application Data

(60) Provisional application No. 63/327,041, filed on Apr. 4, 2022.

(51) Int. Cl.
*A63F 3/04* (2006.01)
*A63F 3/00* (2006.01)

(52) U.S. Cl.
CPC ..... *A63F 3/0423* (2013.01); *A63F 3/00261* (2013.01); *A63F 3/00574* (2013.01); *A63F 2003/00293* (2013.01); *A63F 3/0421* (2013.01); *A63F 2003/0426* (2013.01)

(58) Field of Classification Search
CPC ..... A63F 3/0423; A63F 3/00261; A63F 3/00574; A63F 3/0421; A63F 2003/00293; A63F 2003/0426; A63F 2003/00296; A63F 2003/00608; A63F 2003/00627; A63F 2003/00703; A63F 2003/00757; A63F 2003/00996; A63F 2003/0428
See application file for complete search history.

(56) References Cited

U.S. PATENT DOCUMENTS

| | | | | |
|---|---|---|---|---|
| 7,665,735 | B2 * | 2/2010 | Benedict, III | A63F 3/0423 273/272 |
| 2010/0109247 | A1 * | 5/2010 | Cernansky | A63F 9/12 273/299 |
| 2010/0148437 | A1 * | 6/2010 | Kellond | A63F 9/0402 273/145 C |
| 2014/0327209 | A1 * | 11/2014 | Mizanoski | A63F 3/0423 273/272 |
| 2016/0158637 | A1 * | 6/2016 | Saddler | A63F 9/02 273/272 |
| 2017/0282053 | A1 * | 10/2017 | Malis | A63F 3/0052 |
| 2020/0206601 | A1 * | 7/2020 | Martin, III | A63F 3/02 |
| 2021/0316208 | A1 * | 10/2021 | Wade | A63F 3/00261 |

FOREIGN PATENT DOCUMENTS

| | | | | |
|---|---|---|---|---|
| CA | 2714338 | A1 * | 4/2011 | A63F 3/0423 |
| GB | 2403913 | A * | 1/2005 | A63F 3/0423 |
| GB | 2460758 | A * | 12/2009 | A63F 3/0023 |
| GB | 2597943 | A * | 2/2022 | A63F 3/0423 |

OTHER PUBLICATIONS

DE 202017003875U1—Mechanical randomizer / game board, 18 pages. (Year: 2025).*

* cited by examiner

*Primary Examiner* — Tuyen K Vo

(57) ABSTRACT

A game apparatus having a case, cubes, and tiles. The method of playing the game involves placing or removing tiles on or from said cubes, and then manipulating handles or knobs on the case to transform a row or column of cubes and the associated tiles. During the course of game play, a matrix of visible active tiles is dynamically manipulated by users to achieve game goals.

20 Claims, 17 Drawing Sheets

WORD BOARD GAME APPARATUS AND METHOD

CROSS REFERENCE TO RELATED APPLICATION

This application claims priority to U.S. Provisional Application No. 63/327,041 filed on Apr. 4, 2022, entitled "BOARD GAME COMPRISING INTERACTIVE PHYSICAL COMPONENTS".

TECHNICAL FIELD

The present invention relates to physical and virtual board and table top games. More specifically the invention relates to physical and/or virtual interactive multi-user board and table top games having a dynamic game state and user-manipulatable mechanisms to affect the game state in a deterministic manner while incorporating elements of luck.

BACKGROUND OF THE INVENTION

Board games are physical table top games played by one or more users comprising generally a game board or case and game pieces which are placed, moved, rotated, and otherwise manipulated to achieve game goals by said users either against each other or in cooperation. A game is played by users performing actions in turns in order to influence and advance the game state. Elements of card games may also be present. There are many varieties of board games having a range of themes and rulesets that vary widely in complexity. They incorporate a mixture of elements of luck, strategy and memory. For the purposes of this invention the terms tile and token are taken as interchangeable.

SUMMARY OF THE INVENTION

The invention is a board game comprising a case, cubes, and tiles. A user is able to play the game by placing or removing tiles on or from said cubes, and then manipulating handles or knobs on said case to transform a row or column of cubes and the associated tiles. During the course of came play, a matrix of visible active tiles is dynamically manipulated by users to achieve came coals. Game play incorporates elements of luck in drawing tiles, deterministic transformation of cubes, and memory and strategy of users. The invention can be implemented using physical components and objects, logical or virtual components and objects or a combination of the two.

More specifically, the present invention is a table top board game comprising a case, 25 game cubes, and 150 tiles. The case is dimensioned such that the game cubes can be arranged in a five-by-five layer and placed within the case. The tiles comprise a plurality of thin tokens having on each side one of the 26 letters of the Latin alphabet, each of said tiles having the same letter on each side, the letters being black on one side and red on the opposite side, the number of tiles having a given letter being distributed as follows: of the 150 tokens, 13 have printed on each side the letter 'A', 3 the letter 'B', 5 the letter 'C', 6 the letter 'D', 18 the letter 'E', 3 the letter 'F', 3 the letter 'G', 6 the letter 'H', 9 the letter 'I', the letter 'J', 3 the letter 'K', 9 the letter 'L', 3 the letter 'M', 8 'the letter N', 10 the letter 'O', 5 'P the letter', 1 the letter 'Q', 10 the letter 'R', 9 'the letter S', 11 the letter 'T', 4 the letter 'U', 2 the letter 'V', 3 the letter 'W', 1 the letter 'X', 3 the letter 'Y', and 1 the letter 'Z'.

Said tiles are dimensioned such that they can be removably affixed to the sides of the cubes by users, via a screw-and-lock mechanism actuated by a twisting motion. The case comprises knobs or handles which are manipulated users to rotate a row or column of cubes as a subgroup, exposing a new set of faces and associated tiles. To rotate a row of cubes, a user grasps two opposite and colinear knobs, one in each hand, and pushes them inward towards each other, temporarily locking a subgroup of 5 interposed cubes to the two said knobs. Maintaining this inward temporary locking force, a user then rotates said knobs in the same direction by 90 degrees, thereby rotating the associated row of 5 cubes and exposing a new set of 5 sides of said cubes. Users take turns drawing tiles at random from a bag or pile, placing and affixing tiles on sides of cubes, rotating rows of cubes, and claiming any words formed in rows, columns, or diagonals by the visible letters on the upward facing sides of the 25 cubes.

To those skilled in the art to which this invention relates, many changes in construction and widely differing embodiments and applications of the invention will suggest themselves without departing from the scope of the invention as defined herein. The disclosures and the descriptions herein are purely illustrative and are not intended to be in any sense limiting.

BRIEF DESCRIPTION OF THE DRAWINGS

For a better understanding of the invention including the features, advantages and embodiments, reference is made to the following Figures, in which.

DETAILED DESCRIPTION

While the making and using of the disclosed embodiments of the invention is discussed in detail below, it should be appreciated that the invention provides many applicable inventive concepts which can be embodied in a wide variety of contexts. Some features of the preferred embodiments shown and discussed may be simplified or exaggerated for illustrating the principles of the invention.

Figure 1:
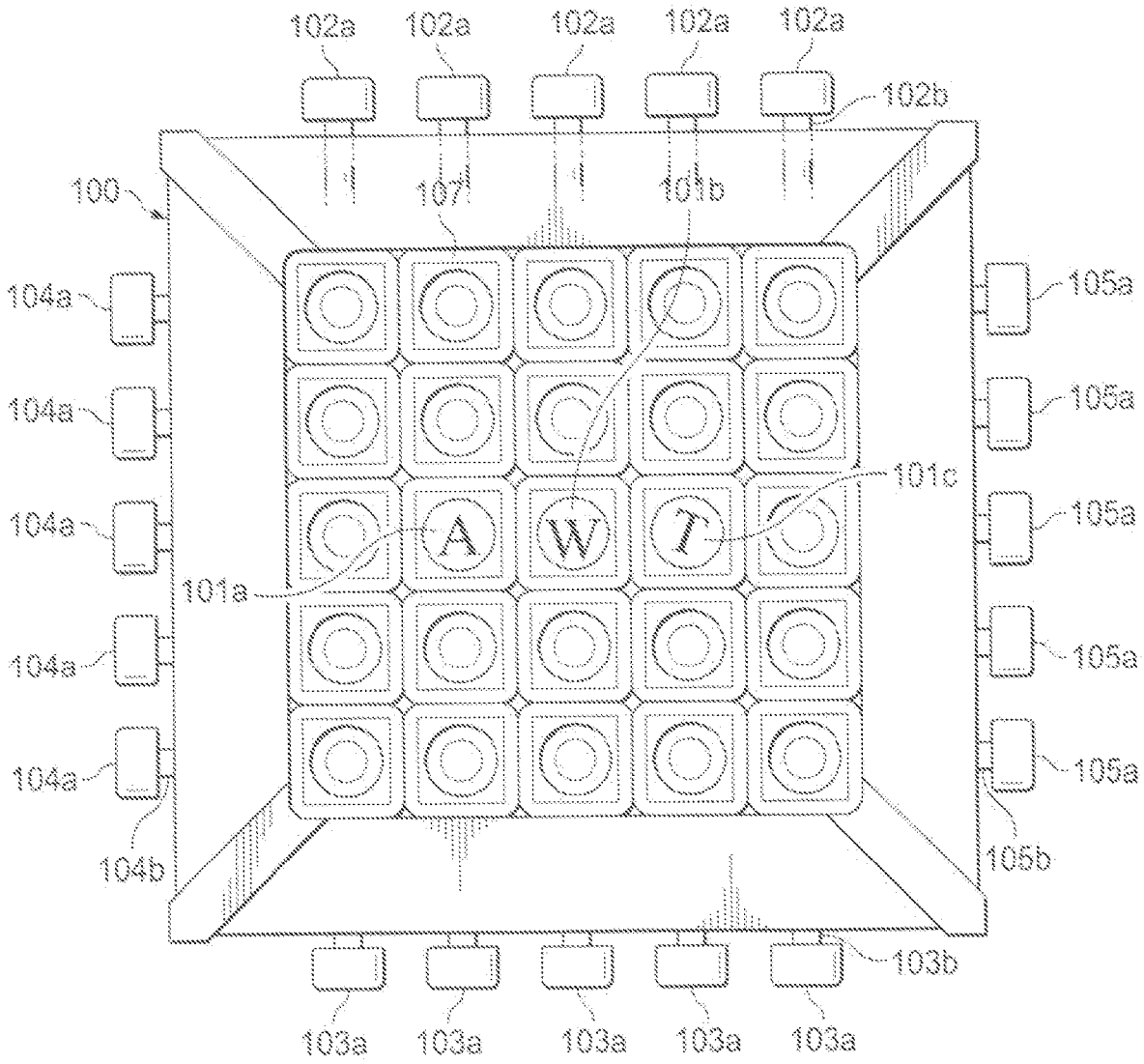
FIG. 1 is a top-down planform view of the case of the invention including on 3 of the cubes thereof, the 3 game tiles with the letters "A", "W" and "T"

Referring now to FIG. 1 there is shown a top-down planform view of the case 100 of the invention and 25 game cubes 107 arranged in a square pattern therein. On 3 of the cubes thereof, the 3 circular game tiles or tokens (referred to herein as tiles) (101*a*, 101*b*, 101*c*) with the letters "A", "W" and "T". The case 100 includes therein 25 rotatable game cubes (107 being one of such cubes), each of the rotatable cubes 107 being rotatable by turning one of the knobs 102, 103, 104, 105) coupled thereto.

Figure 2:
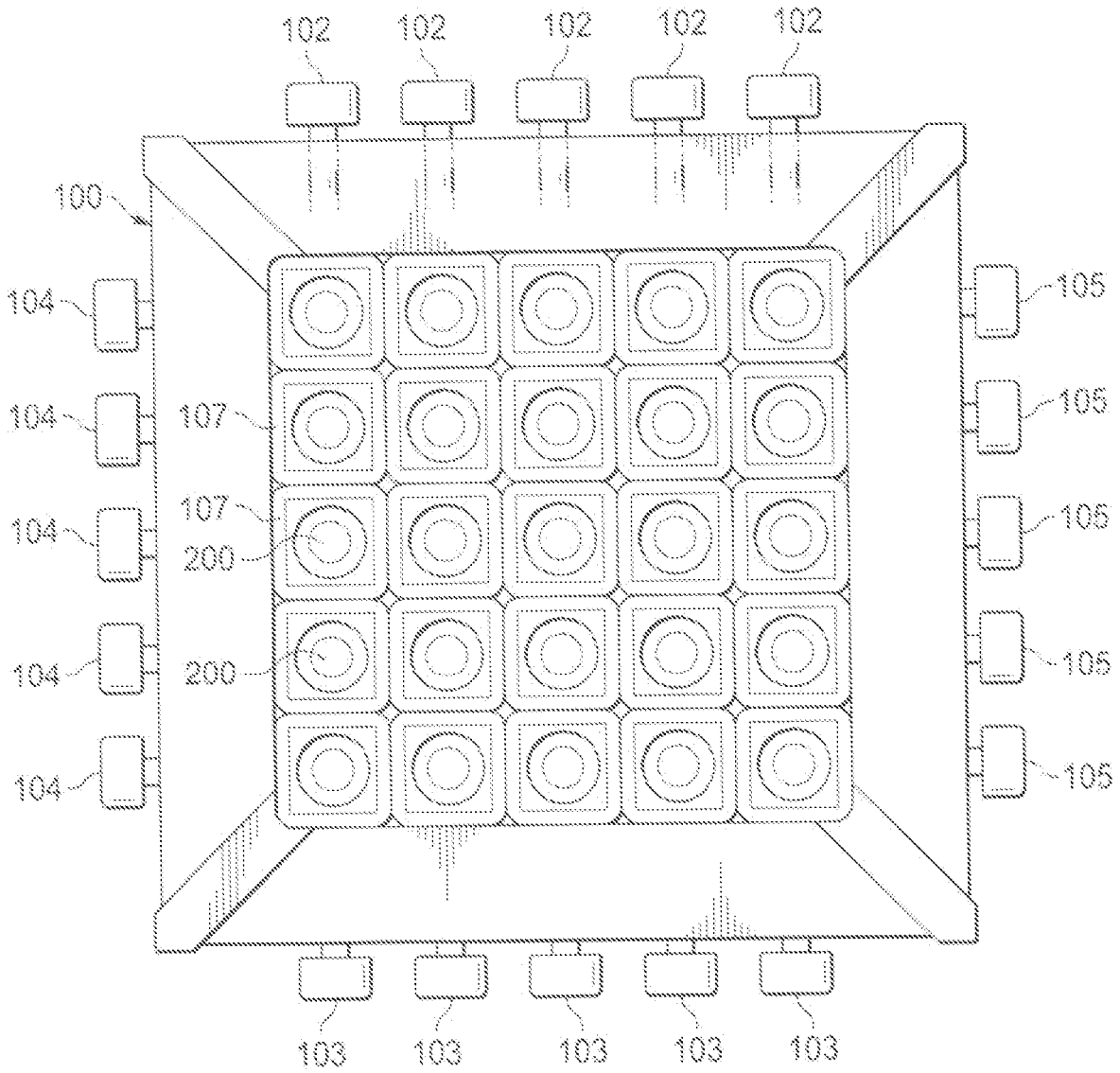
FIG. 2 is a top-down planform view of the present invention labeling said elements.

Referring to FIG. 2, another top-down planform view of the case 100 of the invention is shown, as well as rotatable cubes 107, knobs 102, 103, 104 and 105. Also seen therein within each of the 25 cubes 107 are cutouts 200 dimensioned to receive the tiles. While the invention refers to the game tiles as being circular, such tiles can be any shape and the cutout 200 dimensioned to receive such otherwise shaped tiles.

Figure 3:
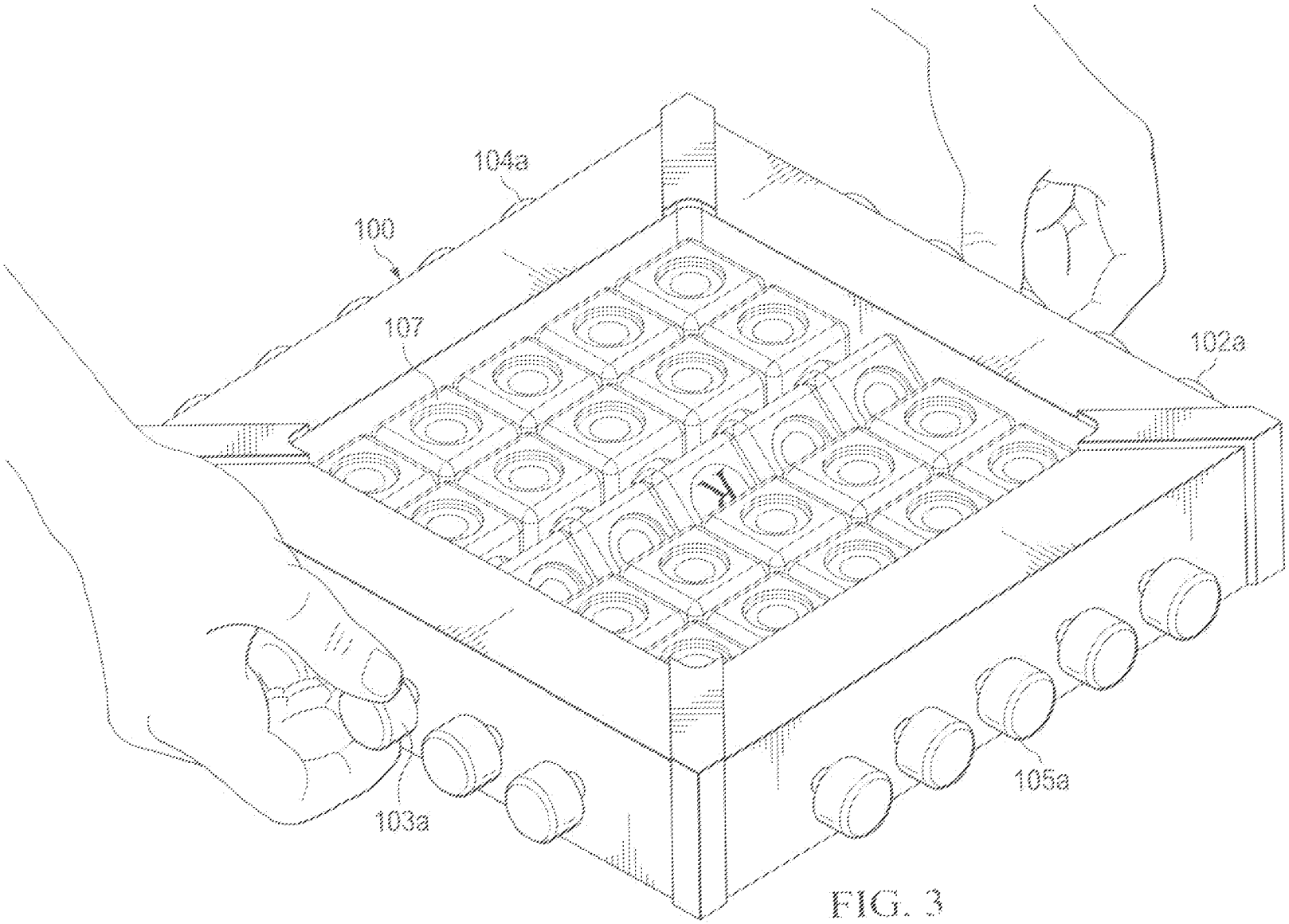
FIG. 3 shows a perspective view of a user turning a column or cubes in an embodiment of the invention.

As seen in FIG. 3, the case 100 is dimensioned as a hollow thick-walled rectangular prism such that the game cubes can be arranged in a five by five by one layer and placed within said case 100.

The 25 game cubes are dimensioned as cubes having rounded edges and 6 faces, each cube comprising on each face a mechanism corresponding to a complementary mechanism on each side of each game tile such that said tiles can be removable affixed to any of said sides of any of said cubes, said mechanism comprising in one embodiment of the present invention a cut out geometry in the form of a short cylinder extruding from the side of a game cube having a partially threaded lateral exterior surface corresponding to a complementary partially threaded rim extending from each side of each tile. In another embodiment of the present invention, said mechanism comprises a simple magnetic attachment between the side of a game cube and an associated tile. In a further embodiment of the present invention, said mechanism comprises a simple corresponding peg and notch geometry actuated by a similar rotating motion of a tile relative to a game cube side.

Figure 4:
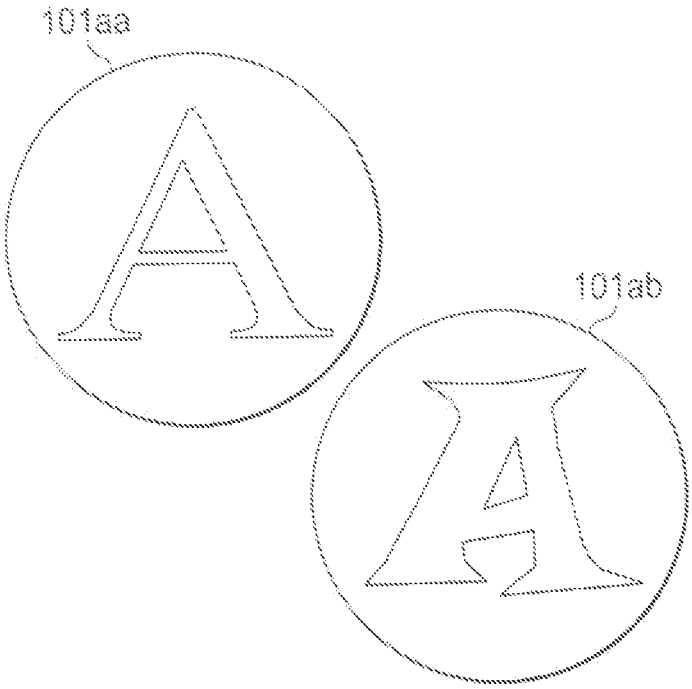
FIG. 4 shows both sides of a game tile or token having the letter 'A'.

The tiles 101*a*, one of which (letter A) is shown in FIG. 4, comprise a plurality of thin tokens having on each side 101*aa*, 101*ab* one of the 26 letters of the Latin alphabet, each of said tiles having the same letter on each side, the letters being black on one side 101*aa* and red 101*ab* on the opposite side, the number of tiles having a given letter being distributed as follows: of the 150 tokens: 13 having printed on each side thereof the letter 'A', 3 having printed on each side thereof the letter 'B', 5 having printed on each side thereof the letter 'C', 6 having printed on each side thereof the letter 'D', 18 having printed on each side thereof the letter 'E', 3 having printed on each side thereof the letter 'F', 3 having printed on each side thereof the letter 'G', 6 having printed on each side thereof the letter 'H', 9 having printed on each side thereof the letter 'I', 1 having printed on each side thereof the letter 'J', 3 having printed on each side thereof the letter 'K', 9 having printed on each side thereof the letter 'L', 3 having printed on each side thereof the letter 'M', 8 having printed on each side thereof the letter 'N', 10 having printed on each side thereof the letter 'O', 5 having printed on each side thereof the letter 'P', 1 having printed on each side thereof the letter 'Q', 10 having printed on each side thereof the letter 'R', 9 having printed on each side thereof the letter 'S', 11 having printed on each side thereof the letter 'T', 4 having printed on each side thereof the letter 'U', 2 having printed on each side thereof the letter 'V', 3 having printed on each side thereof the letter 'W', 1 having printed on each side thereof the letter 'X', 3 having printed on each side thereof the letter 'Y', and 1 having printed on each side thereof the letter 'Z'. One skilled in the art would recognize that different permutations of the number and letters on the tiles can be modified without departing from the scope of the invention as defined herein. Said tiles are dimensioned such that they can be removably affixed to the sides of the cubes by users, via a screw-and-lock mechanism actuated by a twisting motion.

Figure 5A:
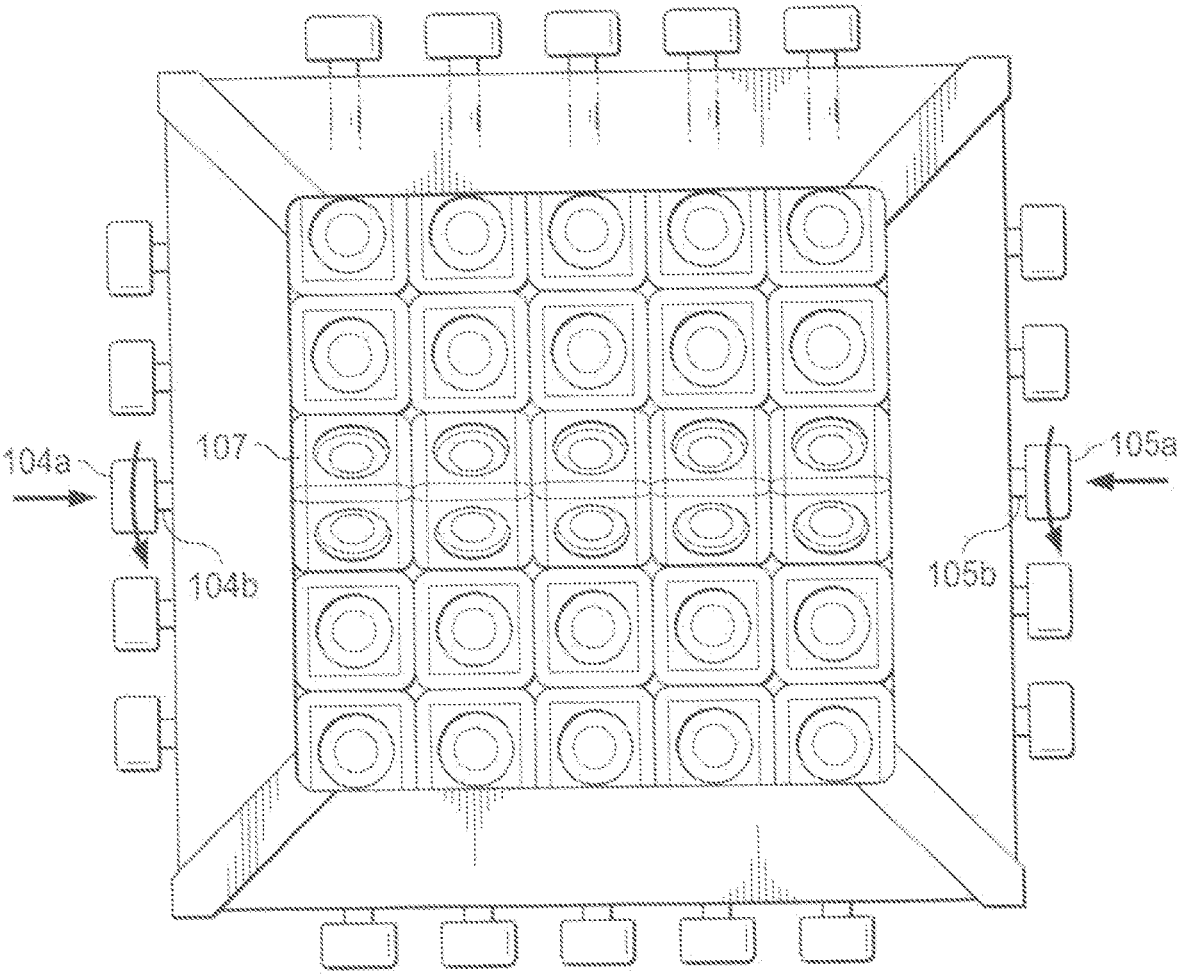
FIGS. 5*a* and 5*b* illustrate the motion of locking and rotating a subgroup row or column of game cubes.

Referring to FIG. 5*a*, in order to rotate a row of 5 cubes 107, a user grasps two opposite and colinear knobs 104*a*, 105*a*, one in each hand, and pushes them inward towards each other, temporarily locking via rods 104*b*, 105*b* a subgroup of 5 interposed cubes 107 to the two said knobs 104*a*, 105*a*. Maintaining this inward temporary locking force, a user then rotates said knobs 104*a*, 105*a* in the same direction by 90 degrees, thereby rotating the associated row of 5 cubes 107 and exposing a new set of 5 sides of said 5 cubes 107. Users take turns drawing tiles 101 at random from a bag or pile, placing, and affixing tiles 101 on sides of cubes 107, rotating rows of cubes 107, and claiming any words formed in rows, columns, or diagonals by the visible letters on the upward facing sides of the 25 cubes 107.

Figure 5B:
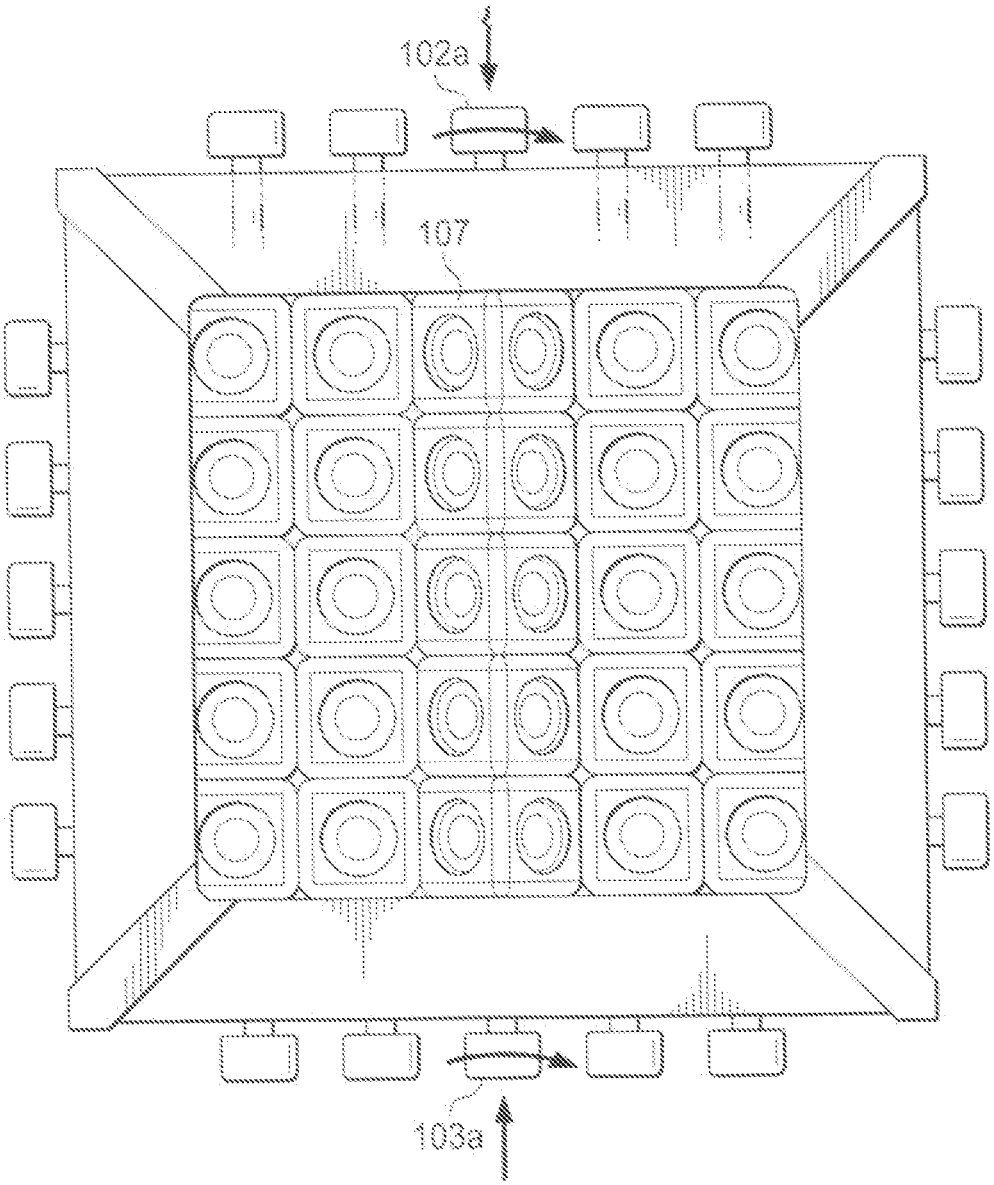
Figure 6A:
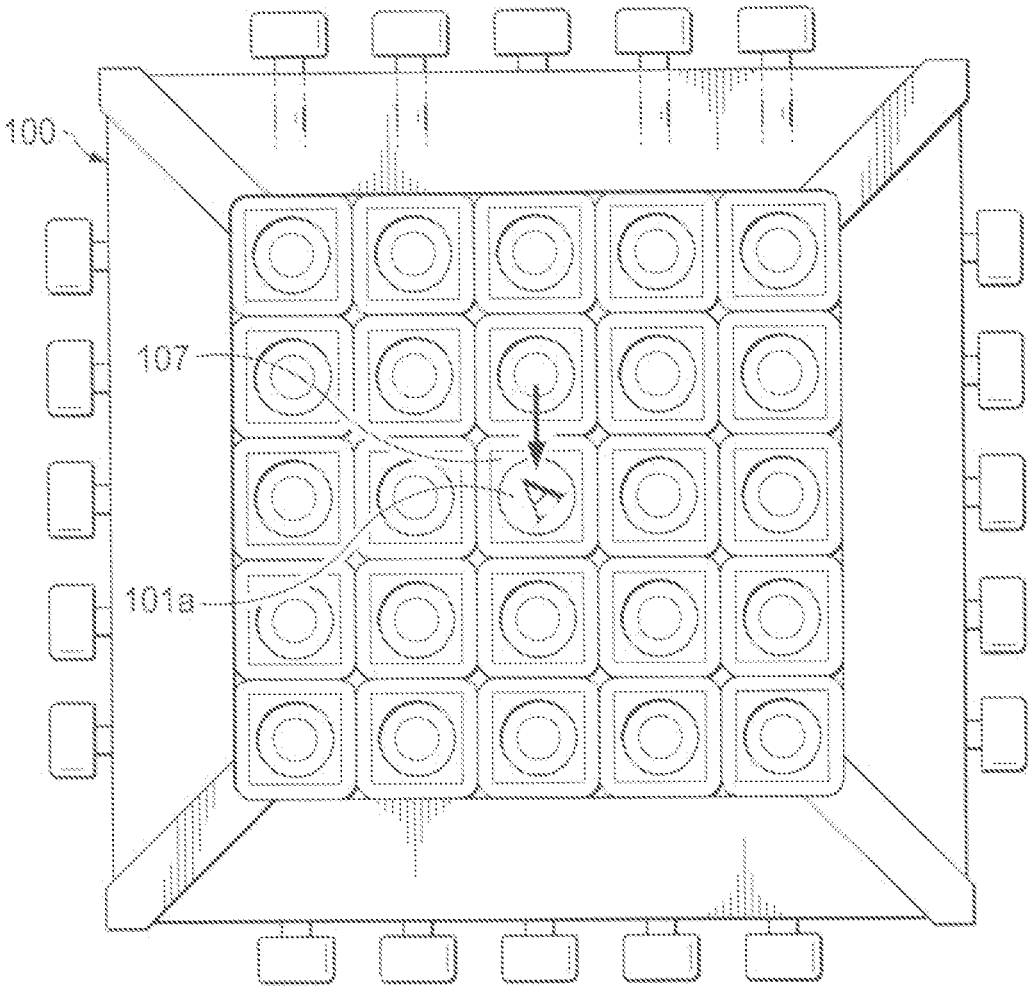
FIGS. 6*a* and 6*b* show the motion of place and turning to affix a tile to a cube.
Figure 6B:
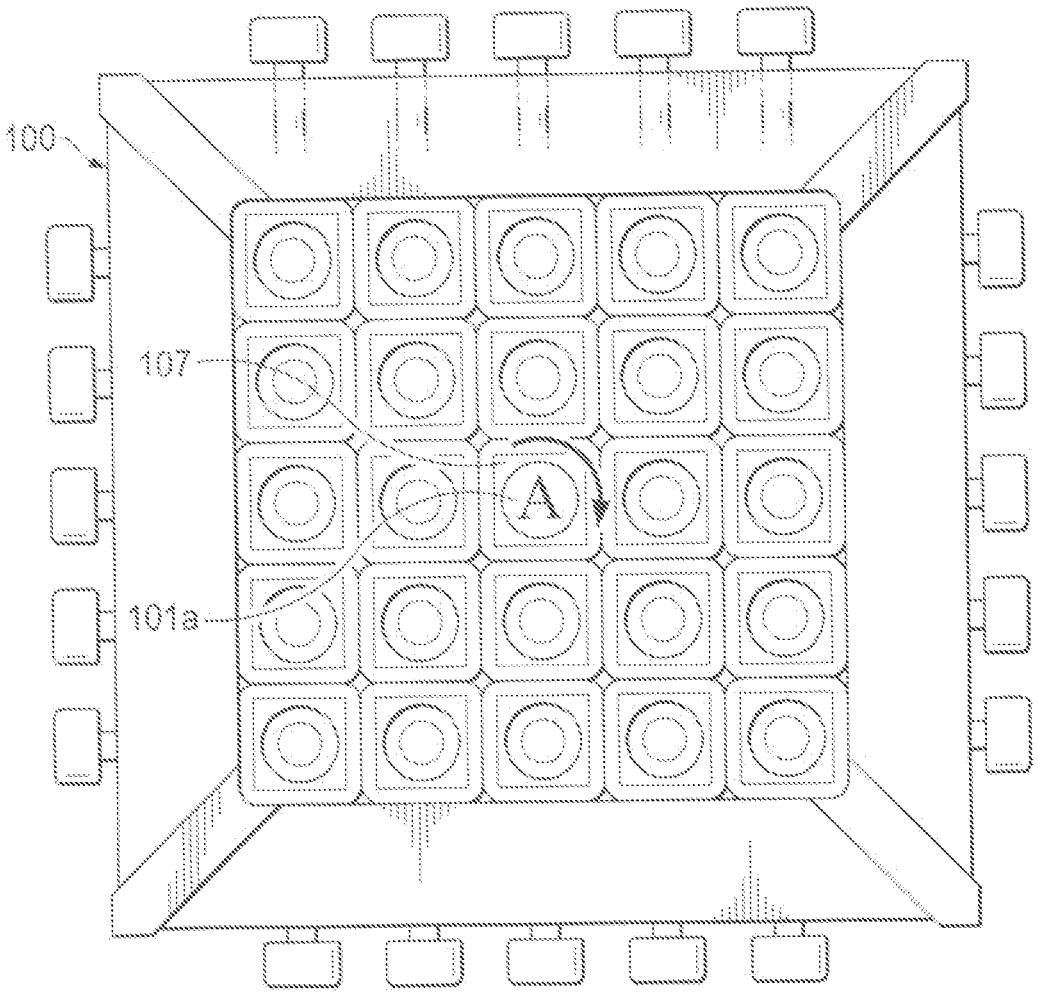

FIGS. 6*a* and 6*b* illustrate the motion of temporarily locking and rotating a subgroup row 104*a*, 105*a* or column 102*a*, 103*a* of game cubes 107. To affix a tile 101 to a cube 107, as shown in FIG. 6*a*, a user places the selected tile 101 so that it is centered on the desired associated cube 107, rotated as seen in FIG. 5*b* so that the letter on said selected tile 101 is oriented at 45 degrees to the sides of said associated cube 107. The user then rotates said tile 101 in a clockwise direction until resistance is encountered. At this point the tile 101 is affixed to its associated cube 107 and the printed letter on the tile 101 is oriented at 90 degrees to the sides of said cube 107.

Figure 7:
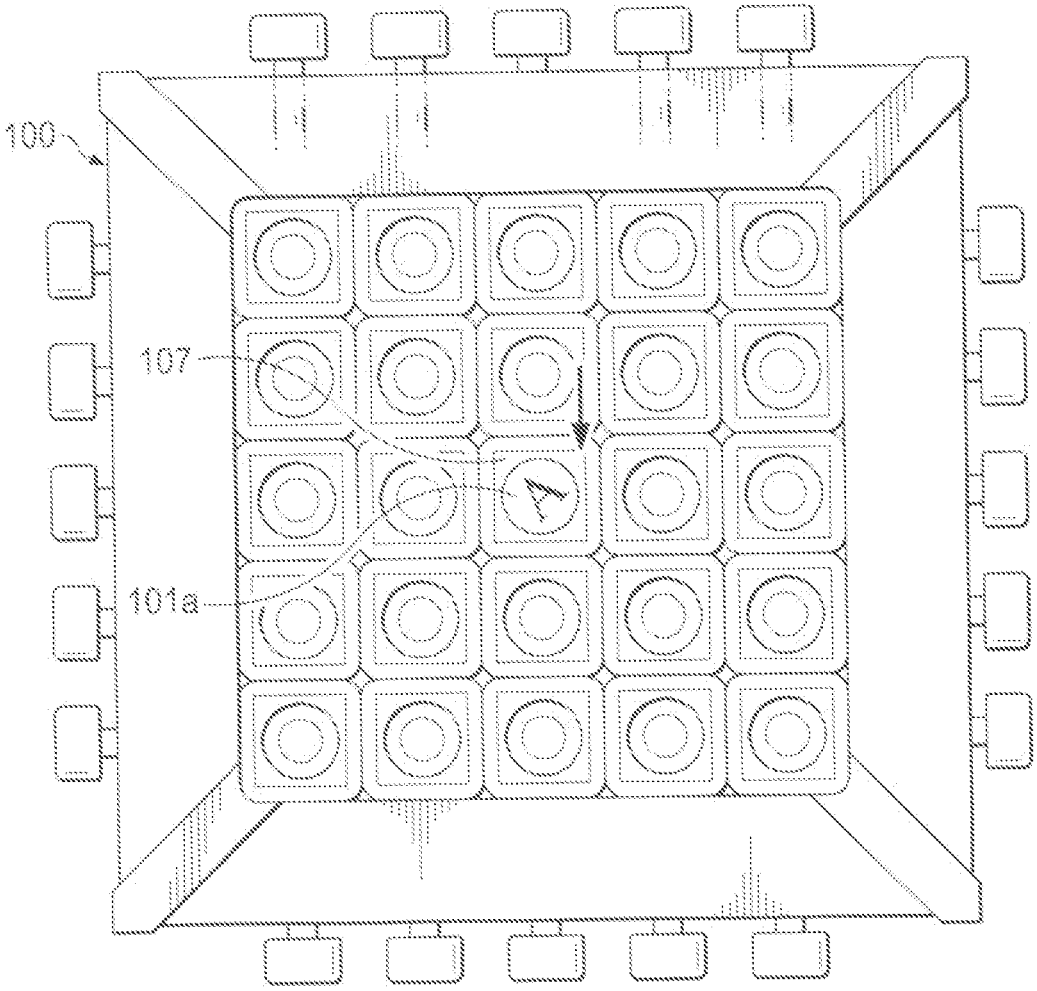
FIG. 7 shows the motion of removing a tile.
Figure 8A:
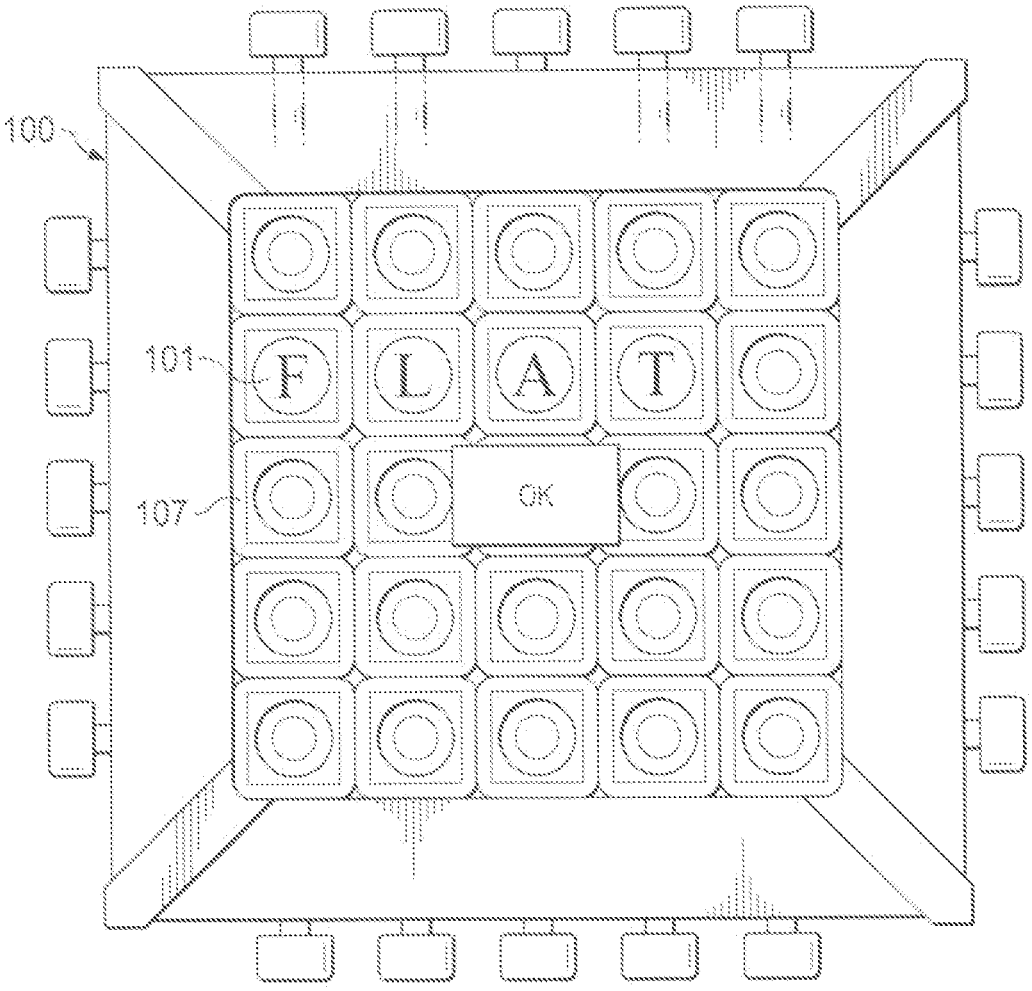
FIGS. 8*a*, 8*b* and 8*c* show valid arrangements of letters into a word in order to claim it, and 8*d* shows an invalid arrangement of letters into a word, in one embodiment of the present invention.
Figure 8B:
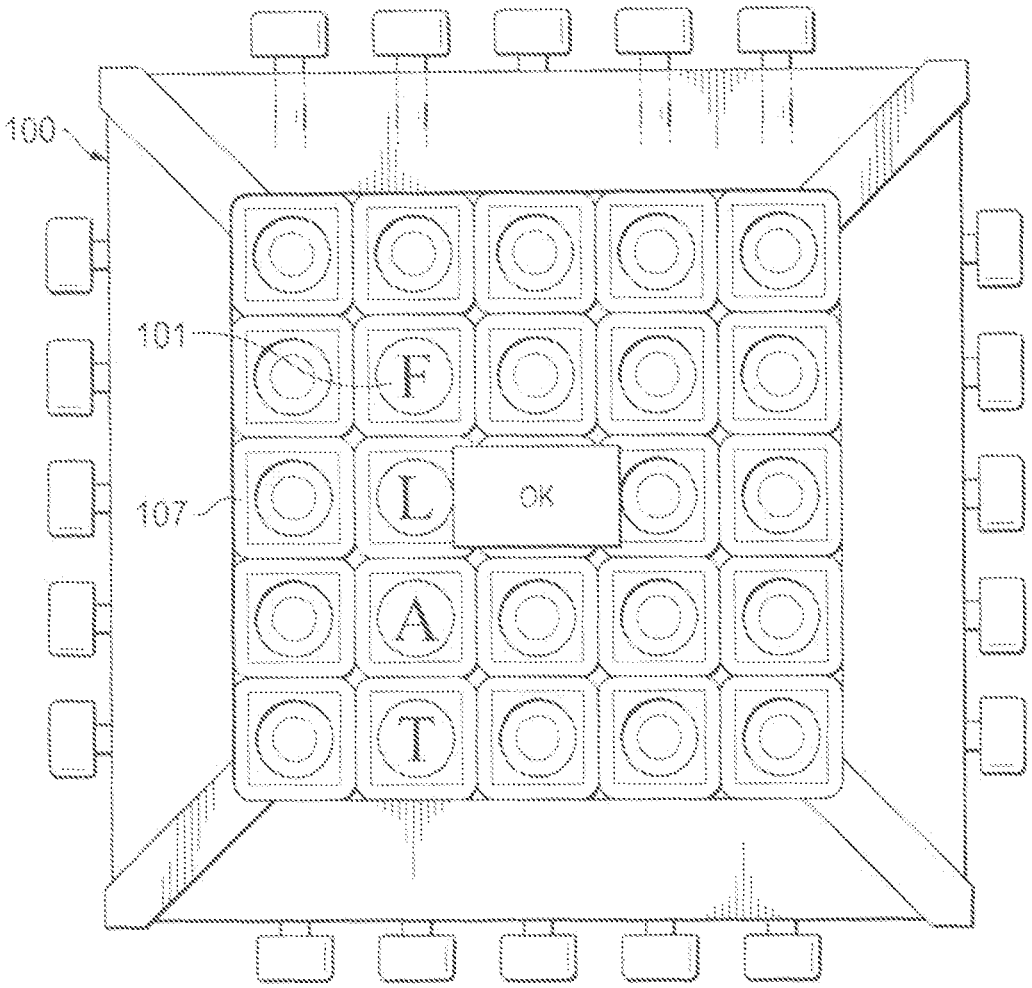
Figure 8C:
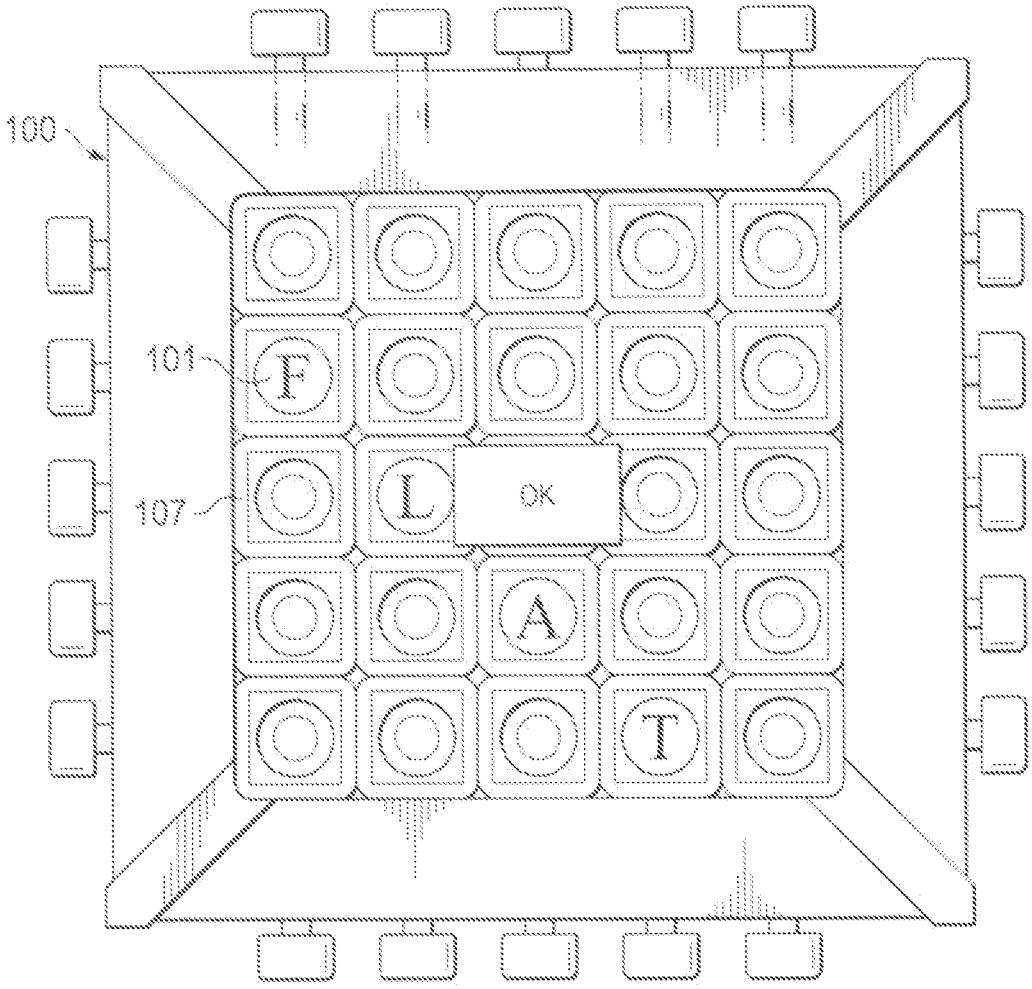
Figure 8D:
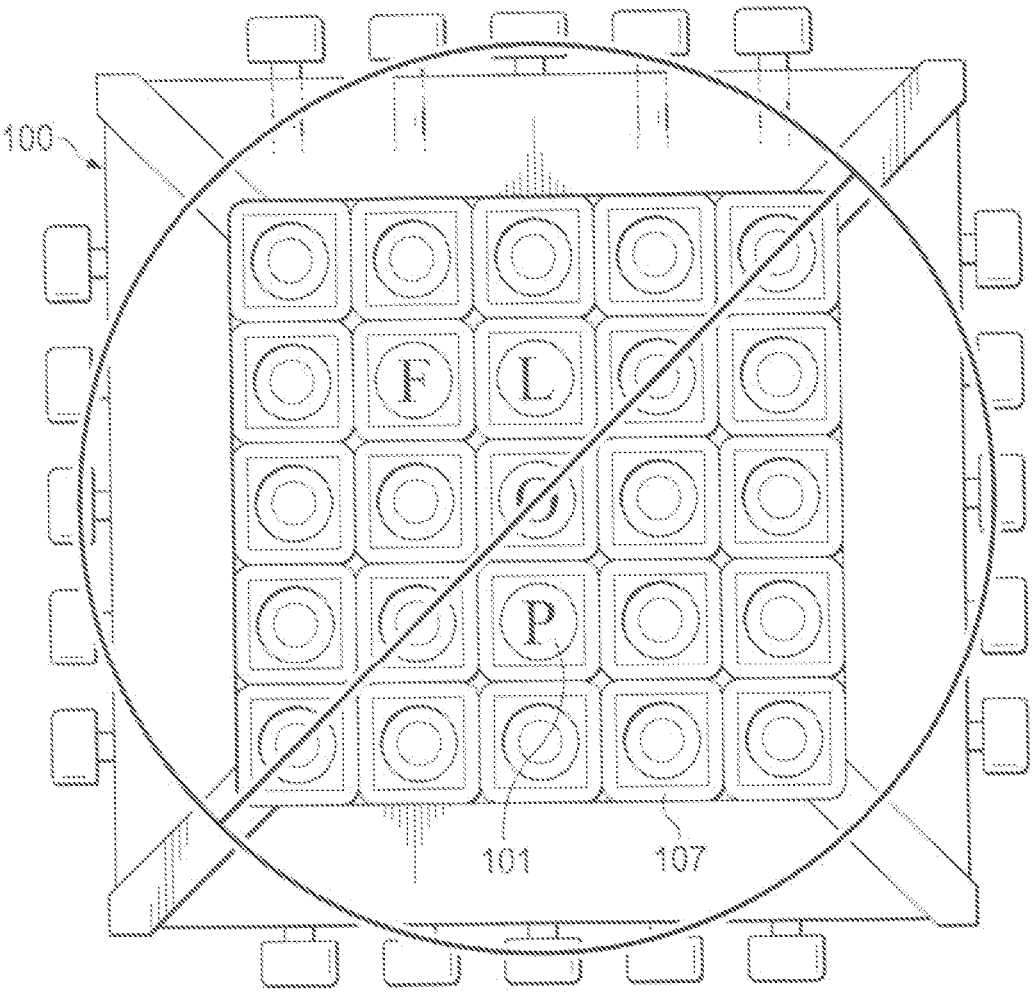
Figure 9A:
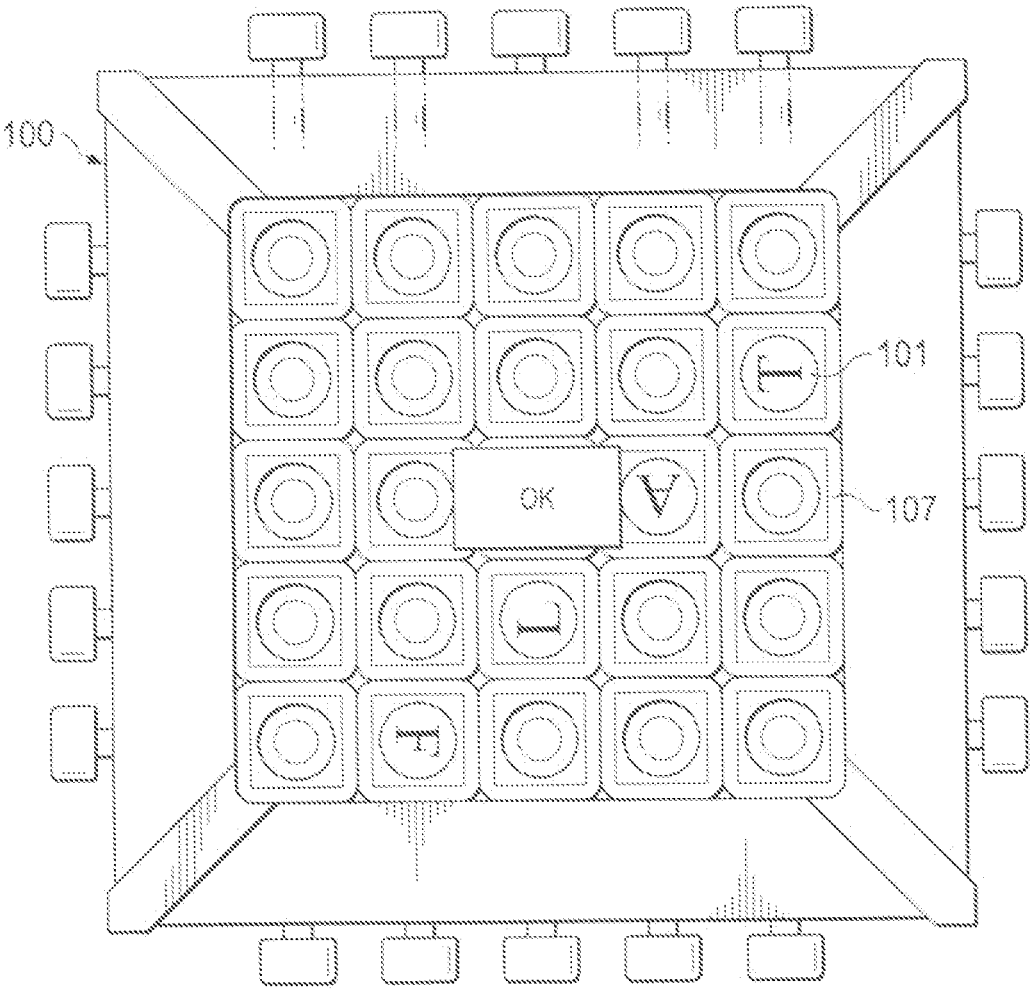
FIGS. 9*a* and 9*b* illustrate that the tiles are orientation-agnostic, in that the validity of a word does not depend on the orientation of letters on said tiles.
Figure 9B:
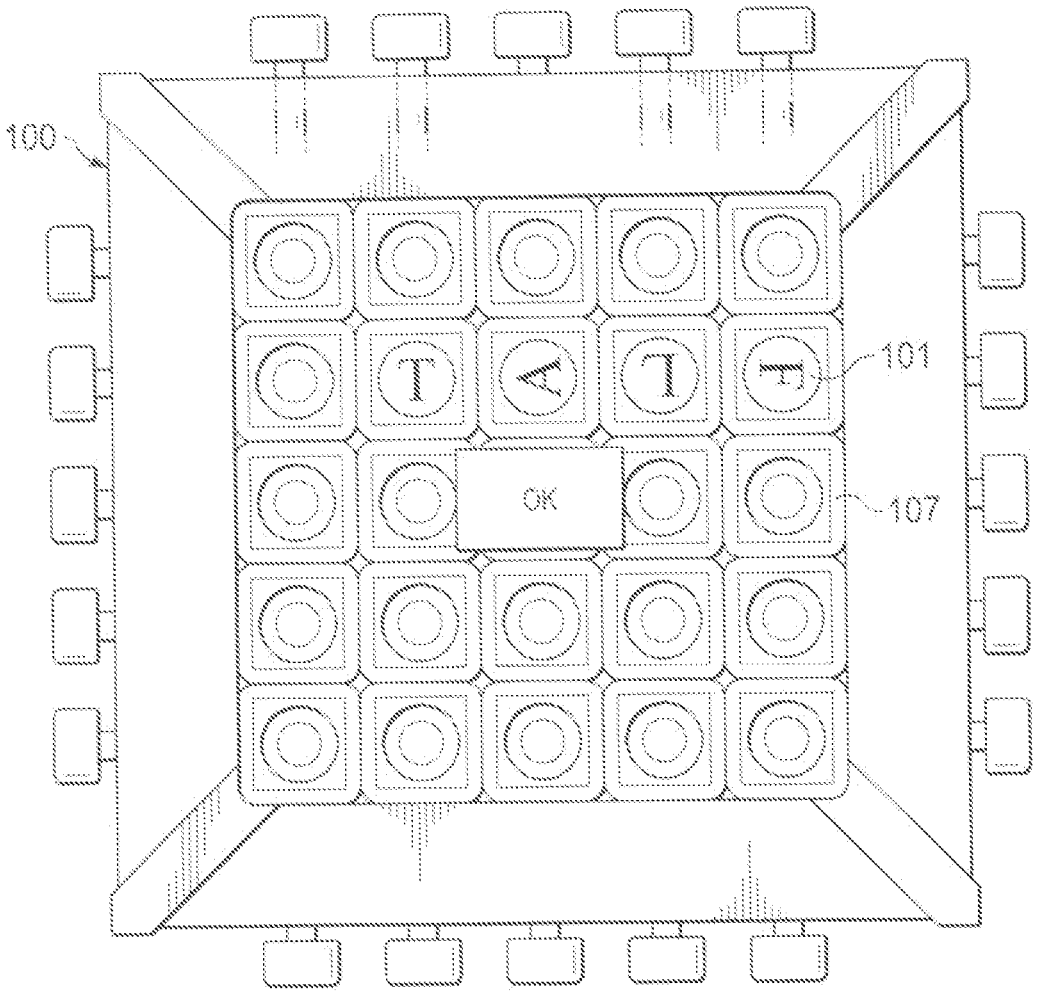

To remove a tile 101*a*, shown in FIG. 7, a user grasps the selected tile 101*a* and rotates counter-clockwise approximately 45 degrees until said tile is unlocked from said cube 107. The user then applies force downwards on an outer edge of said tile 101*a*, levering the opposite edge of said tile 101*a* upwards so that it can be easily removed.

Each tile 101*a* comprises on each side an attachment mechanism, said mechanism comprising in an embodiment of the invention a cut out geometry in the form of a thin rim extending outward from each side of each tile 101*a* in the direction of a vector normal to the surface having printed lettering, the interior lateral surface of said extended rim comprising a partial threading corresponding to a complementary cut out geometry on each side of each game cube 107, said mechanism further comprising in each rim a notch in the partial threading allowing the placement of said tile 101*a* on the side of a selected associated cube 107 prior to the temporary locking rotation.

In another embodiment of the invention, said mechanism comprises a simple magnetic attachment between the side of a game cube 107 and an associated tile 101. In a further embodiment of the invention, said mechanism comprises a simple corresponding peg and notch geometry actuated by a similar rotating motion of a tile 101 relative to a game cube 107 side.

The case 100 comprises knobs 102*a*, 103*a*, 104*a*, 105*a* coupled to rods 102*b*, 103*b*, 104*b*, 105*b*, or handles which are manipulated by users to rotate a row or column of cubes 107 as a subgroup, exposing a new set of faces and associated tiles.

In an embodiment of the invention, the rules of the game are as follows:

All tiles are randomized via being placed in a bag or pile. Each player draws seven tiles at random and can conceal them from others if desired.

The order of turns is determined by choosing a first player and continuing play clockwise. Each player takes a turn in which they perform several actions depending on the state of the game; at the beginning of the game, players may only place one tile per turn, with the black letter facing up, on any empty space anywhere on the playing surface. After a player has claimed their first word, that player may place up to five tiles per turn for the remainder of the game, provided that: the tiles are placed with the black letter lacing upwards; all tiles are placed on the same line, said line being a row, column, or 45-degree diagonal; and all tiles must be part of a claimable word at the time they are placed, although they need not be the same word;

After placing a tile or tiles, the active player must rotate any row or column in either direction 90 degrees, with the condition that the selected row or column must have at least one visible tile on one upward-facing surface of one cube in said selected row or column before rotating.

Any valid spelled words are then scored; valid words are formed when a player places tiles or when the rotation of a row or column exposes letters on previously-hidden cube surfaces and causes words to be formed; the active player claims words by saying them out loud, at which point a designated scorekeeper notes them down using a writing instrument and paper, digital note application, or similar; after a player has claimed as many words as they can, other players are able to claim any words missed by the active player; all tiles having letters in any of the claimed words must then be removed, flipped over and replaced on their respective associated cubes such that the visible letters on the corresponding tiles are colored red;

The active player must then draw tiles from the randomized bag or pile until they hold seven tiles. The next player in the order, proceeding clockwise from the first player, then takes their turn in the same manner.

Referencing FIGS. 8*a-d* and 9*a-b*, valid words are formed on case 101 by upwards-facing, visible tiles 101 on cubes 107 of any orientation arranged in a continuous straight line along a row, column, or 45-degree diagonal, said tiles numbering no less than three and no more than five. Multiple words may be contained within the same row, column, or diagonal of tiles, for example tiles spelling 'CATE' contain the words 'CAT' and 'ATE'; further, words are reversible, for example the tiles spelling 'DOG' can be scored as both 'DOG' and 'GOD'. Valid words may contain any number of red letters but must contain at least one black letter prior to being claimed. Three letter words increment a players score by 3 points, four letter words 5 points, and five letter words 10 points.

The game ends when the game board contains no free empty spaces at the conclusion of any player's turn, such that a tile cannot be played by the next player. At this point the player with the highest score is declared the winner.

Many variations of game rules can be played using the present invention. For example, for quicker and easier games, row column rotations can be constrained to 180 degree turns, such that only the top and bottom surfaces of each cube are used for tile placement. This simplifies the game space considerably.

In another embodiment of the invention, tiles 101 may be of multiple different colors. This adds additional layers of difficulty as valid words may be considered only those containing all letters of one color, or may require all letters to be different colors. Additionally, tiles may contain numbers instead of letters, allowing any number of arithmetic-based rulesets; for example, valid "words" may consist of strings of numbers that sum to a certain amount. In a further embodiment, tiles may depict foods, or plants. Rulesets can then be defined so that players try to claim strings of similar classes of animal, for example, all mammals, birds, or reptiles, in a row or column.

Figure 10:
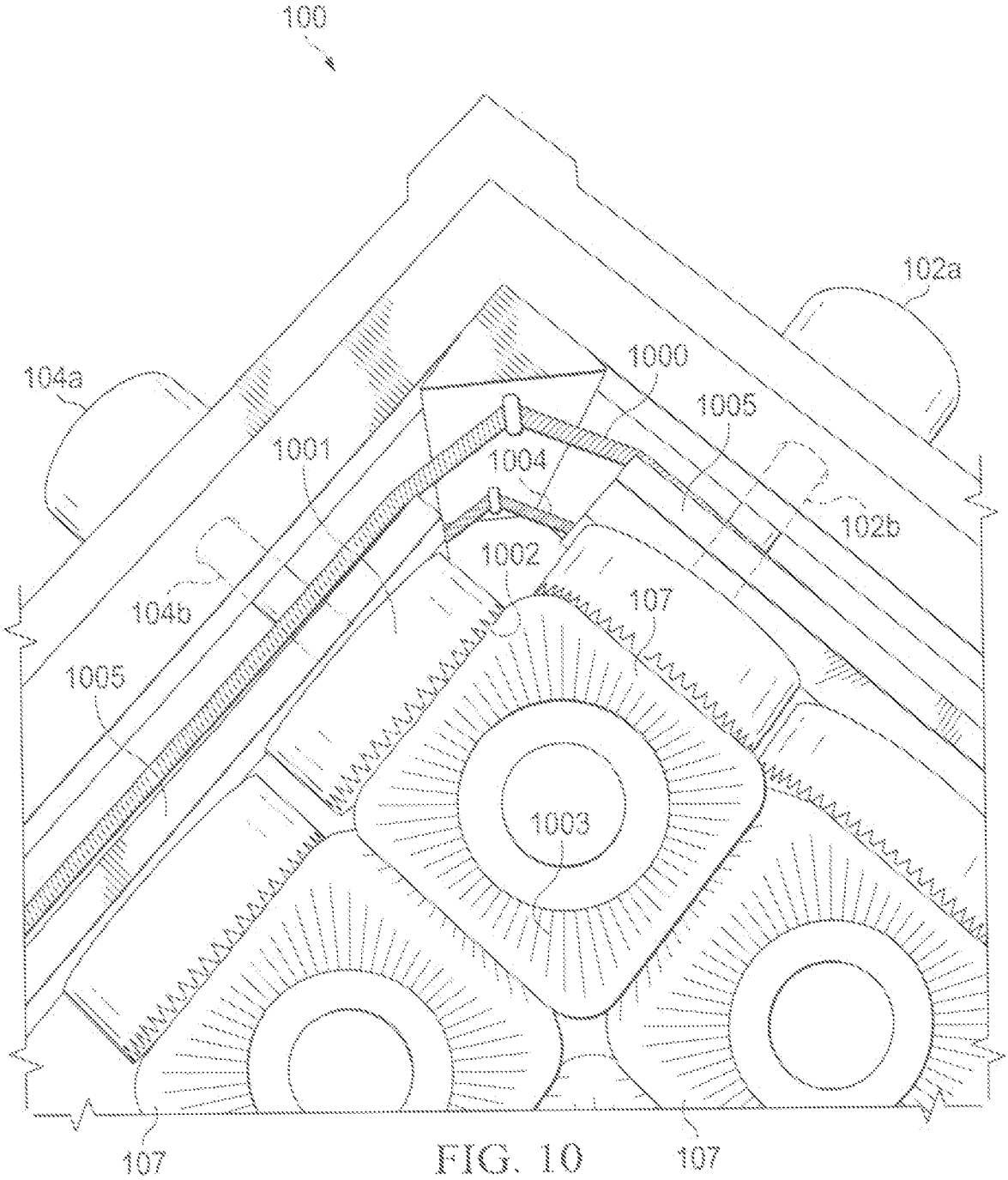
FIG. 10 shows a cutaway view of a corner of the invention showing the mechanical structure of the physical embodiment of the invention.

FIG. 10 is a cutaway drawing of a corner of the case 100 of the invention showing cubes 107, a subset of knobs 102*a*, 104*a*, and a subset of coupled rods 102*b*, 104*b*. As seen therein, a bungee cord 1000 is threaded through apertures in a cross section of the rods around an inner circumference of the case 100 operable to provide tension between the rods and the case. Further, as seen therein, the terminal end of each rod is affixed to a corresponding cube turning member 1001 that makes mates or meshes via splines or ridges 1002 between such cube turning member 1001 against splines or ridges 1003 on the face of a corresponding cube 107 that has corresponding splines or ridges 1003. The splines or ridges 1003 on the cube 107 do not extend from the edges of the face of the cube to the center thereof as the center portion of the face of the cube is reserved for the depression or cutout into which a tile is placed. Each of the 6 faces of the 25 cubes has corresponding splines or ridges. In an embodiment, cube turning member 1001 is a cylindrical shape.

Figure 11:
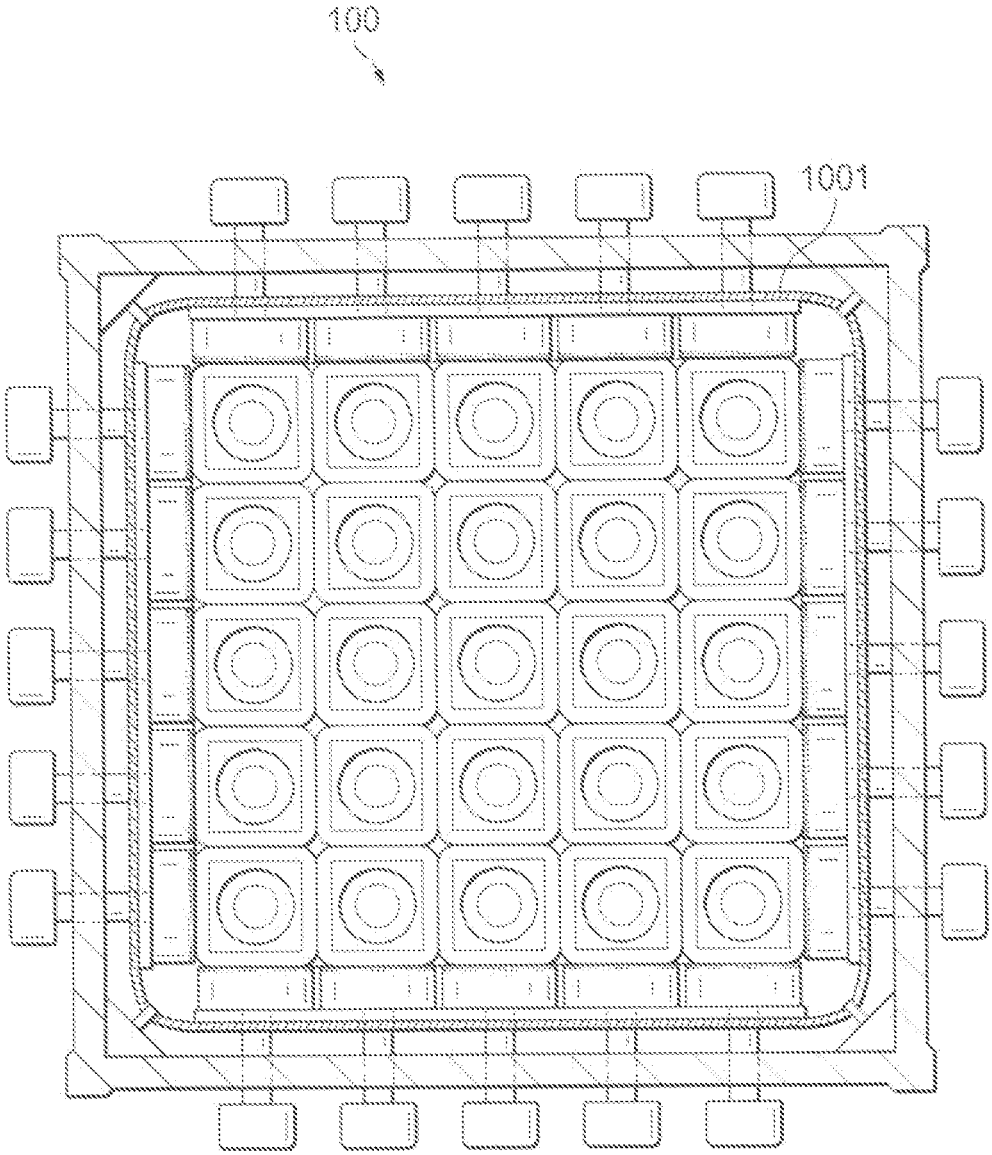
FIG. 11 shows a cutaway top plan view of the invention showing the mechanical structure of the physical embodiment of the invention.

FIG. 11 is a cutaway drawing of case 100 of the invention showing bungee cord 1000 threaded through apertures in a cross section of the rods around an inner circumference of the case 100 and operable to provide tension between the rods and the case.

Alternatively, springs can be provided in case 100 are in coaxial alignment with the rods 102*b*, 103*b*, 104*b* and 105*b*, said rods being coupled to the knobs 102*a*, 103*a*, 104*a* and 105*a* to provide tension between the knobs and rods and the case. In either case, when the knob is pushed inward toward the case, the bungee cord or spring is stretched providing an outward force tending to push the rod and hence knob back to its original position.

In a yet further embodiment of the present invention, the ruleset and game-state manipulation of the game cubes 107 via rotating knobs 102*a*, 103*a*, 104*a*, 105*a* can be easily implemented in an application such that the game can be played digitally on a personal computer or smart phone or similar device having a graphical screen and touchscreen, keyboard and mouse, or other user input means.

The invention is an apparatus for enabling a word game using combinations of letters, comprising: a case having outer four sides and four inner sides and an opening on the top of the case and a closed bottom; a plurality of cubes each cube having 6 faces, dimensioned to fit within the case, the plurality of cubes arranged in a square pattern; a plurality of tiles having thereon letters dimensioned to fit onto the face of any of the plurality of cubes; a plurality of knobs, a subset thereof proximate each side of the case, each knob having an outer face and an inner face; a plurality of rods, each rod having a first end and a second end, each such rod traversing through the outer side and inner side of the case via corresponding apertures, wherein each outer side and inner side of the case has one quarter (¼) of the total number of apertures and each outer side and inner side of the case is configured to receive one quarter (¼) of the total number of rods; the first end of each rod coupled to the inner face of a corresponding knob and the second end of a rod terminating within the case operable to be directly or indirectly applied against one of the faces of the plurality of cubes; and a tensioning or spring mechanism within the case coupled to each knob or rod operable to cause the knob or rod to maintain an equilibrium relative to the case, and further operable to allow movement of the rod so that the second end of the rod is operable to apply pressure to a corresponding face of a cube.

The tensioning, or spring mechanism further comprises a closed bungee cord threaded through an aperture that is perpendicular to the axis of the rod, wherein the axis of the rod contains the centers of the two bases therethrough and the rod is cylindrical or any other symmetrical elongated shape. The plurality of 25 cubes are arranged in a 5 by 5 square pattern in the case, there being 20 knobs and corresponding to 20 rods, the second end of each rod positioned to contact a face of a corresponding cube located within the case. A portion of each Dice of each cube has a depression or cutout for securely receiving one of the 150 tiles. The 150 tiles comprise 13 having printed on each side thereof the letter 'A', 3 having printed on each side thereof the letter 'B', 5 having printed on each side thereof the letter 'C', 6 having printed on each side thereof the letter 'D', 18 having printed on each side thereof the letter 'E', 3 having printed on each side thereof the letter 'F', 3 having printed on each side thereof the letter 'G', 6 having printed on each side thereof the letter 'H', 9 having printed on each side thereof the letter 'I', 1 having printed on each side thereof the letter 'J', 3 having printed on each side thereof the letter 'K', 9 having printed on each side thereof the letter 'L', 3 having printed on each side thereof the letter 'M', 8 having printed on each side thereof the letter 'N', 10 having printed on each side thereof the letter 'O', 5 having printed on each side thereof the letter 'P', 1 having printed on each side thereof the letter 'Q', 10 having printed on each side thereof the letter 'R', 9 having printed on each side thereof the letter 'S', 11 having printed on each side thereof the letter 'T', 4 having printed on each side thereof the letter 'U', 2 having printed on each side thereof the letter 'V', 3 having printed on each side thereof the letter 'W', 1 having printed on each side thereof the letter 'X', 3 having printed on each side thereof the letter 'Y', and 1 having printed on each side thereof the letter 'Z'. On one side of the tile, the letter is of a first color and on the other side of the tile, the color is of a second color, such as block and red. All the tiles are of a consistent shape for example but not limited to being selected front the shapes consisting of circular, square, pentagonal, hexagonal and octagonal.

Each side of the case has an outer wall and an inner wall and a hollow space therein-between, the inner walls of the case dimensioned such that the game cubes can be arranged in a five by five by one layer and placed within said case. The tensioning or spring mechanism comprises a closed bungee cord around the circumference of the case within the hollow space between the case outer wall and inner wall, the bungee cord threaded through an aperture that is perpendicular to the axis of the rod, wherein the axis of the rod contains the centers of the two bases there-through.

The plurality of cubes have rounded edges, each cube comprising on each face a mechanism corresponding to a complementary mechanism on each side of each tile such that said each tile can be removably affixed to any of said sides of any of said cubes.

The invention is also a method of game play, comprising the steps of: drawing a tile at random from a plurality of tiles, each tile having an associated letter: affixing such tile to an empty side of a cube object from a plurality of cube objects; rotating a row or column of a subset of the plurality of cube objects to further expose an empty side of at least one of the cube objects; and claiming, if any, bona-fide words formed in rows, columns, or diagonals by the visible letters on the upward facing sides of the cube objects; and repeating the rotating and claiming steps until all sides of all the cube objects are occupied with tiles.

The game play further comprises the steps of only placing, at the beginning of the game, one tile per turn, with the black letter facing up, on any empty space anywhere on the playing surface; after claiming a first word, placing up to five tiles per turn for the remainder of the game, provided that the tiles are placed with the black letter facing upwards; placing all tiles on the same line, said line being a row, column, or 45 degree diagonal; and all tiles must be part of a claimable word at the time they are placed, although they need not be the same word; after placing a tile or tiles, rotating any row or column in either direction 90 degrees, with the condition that the selected row or column must have at least one visible tile on one upward-facing surface of one cube in said selected row or column before rotating; scoring any valid spelled words wherein valid words are formed when tiles are placed or when the rotation of a row or column exposes letters on previously-hidden cube surfaces and causes words to be formed; claiming words by saving them out loud, at which point a score is noted; claiming as many words as possible, other plater being able to claim any words missed by an active player; removing all tiles having letters in any of the claimed words by flipping such tiles over and replacing them on their respective associated cubes such that the visible letters on the corresponding tiles are colored red; drawing tiles by the active player from the randomized bag or pile until they hold seven tiles; and taking a turn by the next player in order and proceeding clockwise from the first player, in the foregoing manner.

Valid words are formed by upwards-facing, visible tiles of any orientation arranged in a continuous straight line along a row, column, or 45-degree diagonal, said tiles numbering no less than three and no more than five. Multiple words may be contained within the same row, column, or diagonal of tiles. Three letter words increment a players score by 3 points, four letter words 5 points, and five letter words 10 points. The game ends when the game board contains no free empty spaces at the conclusion of any player's turn, such that a tile cannot be played by the next player and at this point the player with the highest score is declared the winner.

The plurality of tiles and cube objects are one selected from the group of virtual items and physical items. If the tiles and cube objects are physical items then the case has four sides and an opening on the top of the case and a closed bottom, the cube objects being a plurality of cubes each cube having 6 faces, dimensioned to fit within the case, arranged in a square pattern, a plurality of tiles having thereon letters dimensioned to fit onto the face of any of the plurality cubes, a plurality of knobs on each side of the case, each knob having an outer face and an inner face, a plurality of rods, each rod having a first end and a second end, each such rod traversing through a side of the case via corresponding aperture, wherein each side of the case has one quarter (¼) of the total number of apertures and each side of the case is configured to receive one quarter (¼) of the total number of rods, the first end of each rod coupled to the inner face of a corresponding knob and the second end of a rod terminating within the case operable to be directly or indirectly applied against one of the plurality of cubes; and a tensioning or spring mechanism within the case coupled to each knob or rod operable to cause the knob or rod to maintain an equilibrium relative to the case, and further operable to allow movement of the rod so that the second end of the rod can apply pressure to a corresponding face of a cube. To engage in the game, the steps further comprise grasping two opposite and colinear knobs; pushing the knobs inward towards each other; temporarily locking via corresponding rods coupled to the knobs a subgroup or 5 interposed cubes to the two said knobs; while maintaining this inward temporary locking force; rotating said knobs in the same direction by 90 degrees, thereby rotating the associated row of 5 cubes and exposing a new set of 5 sides of said 5 cubes.

The embodiments shown and described above are only exemplary. Even though numerous characteristics and advantages of the present invention have been set forth in the foregoing description together with details of the apparatus and methods of the invention, the disclosure is illustrative only and changes may be made within the principles of the invention to the full extent indicated by the broad general meaning of the terms used herein. Various alterations, modifications and substitutions can be made to the apparatus and methods of the disclosed invention system without departing in any way from the spirit and scope of the invention.

I claim:

1. An apparatus for enabling a word game using combinations of letters, comprising:

a case having outer four sides and four inner sides and an opening on the top of the case and a closed bottom;

a plurality of cubes each cube having 6 faces, dimensioned to fit within the case, the plurality of cubes arranged in a square pattern, a plurality of tiles having thereon letters dimensioned to fit onto the face of any of the plurality of cubes;

a plurality of knobs, a subset thereof proximate each side of the case, each knob having an outer face and an inner face;

a plurality of rods, each rod having a first end and a second end, each such rod traversing through the outer side and inner side of the case via corresponding apertures, wherein each outer side and inner side of the case has one quarter (¼) of the total number of apertures and each outer side and inner side of the case is configured to receive one quarter (¼) of the total number of rods;

the first end of each rod coupled to the inner face of a corresponding knob and the second end of a rod terminating within the case operable to be directly or indirectly applied against one of the faces of the plurality of cubes via a cube turning member; and a tensioning or spring mechanism within the case coupled to each knob or rod operable to cause the knob or rod to maintain an equilibrium relative to the case, and further operable to allow movement of the rod so that the second end of the rod is operable to apply pressure to corresponding face of a cube.

2. The apparatus of claim 1, wherein the tensioning or spring mechanism comprises a closed bungee cord threaded through an aperture that is perpendicular to the axis of the rod, wherein the axis of the rod contains the centers of the two bases therethrough.

3. The apparatus of claim 2, wherein in the rod is cylindrical.

4. The apparatus or claim 1, wherein the plurality of cubes is 25 arranged in a 5 by 5 square pattern in the case, there being 20 knobs and corresponding to 20 rods, the second end of each rod positioned to contact a face of a corresponding cube located within the case.

5. The apparatus of claim 4, further comprising each face of each cube having a depression or cutout for securely receiving one of the 150 tiles.

6. The apparatus of claim 5, wherein the 150 tiles comprise 13 having printed on each side thereof the letter 'A', 3 having printed on each side thereof the letter 'B', 5 having printed on each side thereof the letter 'C', 6 having printed on each side thereof the letter 'D', 18 having printed on each side thereof the letter 'E', 3 having printed on each side thereof the letter 'F', 3 having printed on each side thereof the letter 'G', 6 having printed on each side thereof the letter 'H', 9 having printed on each side thereof the letter 'I', 1 having printed on each side thereof the letter 'J', 3 having printed on each side thereof the letter 'K', 9 having printed on each side thereof the letter 'L', 3 having printed on each side thereof the letter 'M', 8 having printed on each side thereof the letter 'N', 10 having printed on each side thereof the letter 'O', 5 having printed on each side thereof the letter 'P', 1 having printed on each side thereof the letter 'Q', 10 having printed on each side thereof the letter 'R', 9 having printed on each side thereof the letter 'S', 11 having printed on each side thereof the letter 'T', 4 having printed on each side thereof the letter 'U', 2 having printed on each side thereof the letter 'V', 3 having printed on each side thereof the letter 'W', 1 having printed on each side thereof the letter 'X', 3 having printed on each side thereof the letter 'Y', and 1 having printed on each side thereof the letter 'Z'.

7. The apparatus of claim 6, wherein on one side of the tile, the letter is of a first color and on the other side of the tile, the color is of a second color.

8. The apparatus of claim 6, wherein all the tiles are of a consistent shape selected from the shapes consisting of circular, square, pentagonal, hexagonal and octagonal.

9. The apparatus of claim 1, wherein each side of the case has an outer wall and an inner wall and a hollow space therein-between, the inner walls of the case dimensioned such that the game cubes can be arranged in a five by five by one layer and placed within said case.

10. The apparatus of claim 9, wherein the tensioning or spring mechanism comprises a closed bungee cord around the circumference of the case within the hollow space between the case outer wall and inner wall, the bungee cord threaded through an aperture that is perpendicular to the axis of the rod, wherein the axis of the rod contains the centers of the two bases there-through.

11. The apparatus of claim 10, wherein the plurality of cubes have rounded edges, each cube comprising on each face mechanism corresponding to a complementary mechanism on each side of each tile such that said each tile can be removably affixed to any of said sides of any of said cubes.

12. A method of game play, comprising the steps of:

drawing a tile at random from a plurality of tiles, each tile having an associated letter;

affixing such tile to an empty side of a cube object hour a plurality of cube objects;

rotating a row or column of a subset of the plurality of cube objects to further expose an empty side of least one of the cube objects;

claiming, if any, bona-fide words formed in rows, columns, or diagonals by the visible letters on the upward facing sides of the cube objects; and repeating the rotating and claiming steps until all sides of all the cube objects are occupied with tiles.

13. The method of game play of claim 12, further comprising the steps of:

only placing, at the beginning of the game, one tile per turn, with the black letter facing up, on any empty space anywhere on the playing surface;

after claiming a first word, placing up to five tiles per turn for the remainder of the game, provided that the tiles are placed with the black letter facing upwards;

placing all tiles on the same line, said line being a row, column, or 45 degree diagonal; and all tiles must be part of a claimable word at the time they are placed, although they need not be the same word;

after placing a tile or tiles, rotating any row or column in either direction 90 degrees, with the condition that the selected row or column must have at least one visible tile on one upward-facing surface of one cube in said selected row or column before rotating;

scoring any valid spelled words wherein valid words are formed when tiles are placed or when the rotation of a row or column exposes letters on previously-hidden cube surfaces and causes words to be formed;

claiming words by saying them out loud, at which point a score is noted;

claiming as many words as possible, other player being able to claim any words missed by an active player;

removing all tiles having letters in any of the claimed words by flipping such tiles over and replacing them on their respective associated cubes such that the visible letters on the corresponding tiles are colored red;

drawing tiles by the active player from the randomized bag or pile until they hold seven tiles; and taking a turn by the next player in order and proceeding clockwise from the first player, in the foregoing manner.

14. The method of claim 13 wherein valid words are formed by upwards-facing, visible tiles of any orientation arranged in a continuous straight line along a row, column, or 45 degree diagonal, said tiles numbering no less than three and no more than five.

15. The method of claim 14 wherein multiple words may be contained within the same row, column, or diagonal of tiles.

16. The method of claim 15 wherein three letter words increment a players score by 3 points, four letter words 5 points, and five letter words 10 points.

17. The method of claim 16, wherein the game ends when the game board contains no free empty spaces at the conclusion of any player's turn, such that a tile cannot be played by the next player and at this point the player with the highest score is declared the winner.

18. The method of game play of claim 12, wherein the plurality of tiles and cube objects are one selected from the group of virtual items and physical items.

19. The method of game play of claim 18, wherein the tiles and cube objects are physical items further comprising a case having four sides and an opening on the top of the case and a closed bottom, the cube objects being a plurality of cubes each cube having 6 faces, dimensioned to fit within the case, arranged in a square pattern, a plurality of tiles having thereon letters dimensioned to fit onto the face of any of the plurality of cubes, a plurality of knobs on each side of the case, each knob having an outer face and an inner face, a plurality of rods, each rod having a first end and a second end, each such rod traversing through a side of the case via corresponding aperture, wherein each side of the case has one quarter (¼) of the total number of apertures and each side of the case is configured to receive one quarter (¼) of the total number of rods, the first end of each rod coupled to the inner face of a corresponding knob and the second end of a rod terminating within the case operable to be directly or indirectly applied against one of the plurality of cubes via a cube turning member; and a tensioning or spring mechanism within the case coupled to each knob or rod operable to cause the knob or rod to maintain an equilibrium relative to the case, and further operable to allow movement of the rod so that the second end of the rod can apply pressure to a corresponding face of a cube, the method further comprising the steps of:

grasping two opposite and colinear knobs;

pushing the knobs inward towards each other;

temporarily locking via corresponding rods coupled to the knobs a subgroup of 5 interposed cubes to the two said knobs;

while maintaining this inward temporary locking force;

rotating said knobs in the same direction by 90 degrees, thereby rotating the associated row of 5 cubes; and exposing a new set of 5 sides of said 5 cubes.

20. The method of game of claim 19, wherein there are 150 tiles comprising 13 having printed on each side thereof the letter 'A', 3 having printed on each side thereof the letter 'B', 5 having printed on each side thereof the letter 'C', 6 having printed on each side thereof the letter 'D', 18 having printed on each side thereof the letter 'E', 3 having printed on each side thereof the letter 'F', 3 having printed on each side thereof the letter 'G', 6 having printed on each side thereof the letter 'H', 9 having printed on each side thereof the letter 'H', 1 having printed on each side thereof the letter 'J', 3 having printed on each side thereof the letter 'K', 9 having printed on each side thereof the letter 'L', 3 having printed on each side thereof the letter 'M', 8 having printed on each side thereof the letter 'N', 10 having printed on each side thereof the letter 'O', 5 having printed on each side thereof the letter 'P', 1 having printed on each side thereof the letter 'Q', 10 having printed on each side thereof the letter 'R', 9 having printed on each side thereof the letter 'S', 11 having printed on each side thereof the letter 'T', 4 having printed on each side thereof the letter 'U', 2 having printed on each side thereof the letter 'V', 3 having printed on each side thereof the letter 'W', 1 having printed on each side thereof the letter 'X', 3 having printed on each side thereof the letter 'Y', and 1 having printed on each side thereof the letter 'Z'.

* * * * *